US008794330B2

(12) United States Patent
Stout

(10) Patent No.: US 8,794,330 B2
(45) Date of Patent: Aug. 5, 2014

(54) APPARATUS FOR SINGLE-TRIP TIME PROGRESSIVE WELLBORE TREATMENT

(75) Inventor: Gregg W. Stout, Montgomery, TX (US)

(73) Assignee: Completion Tool Developments, Inc., Willis, TX (US)

( * ) Notice: Subject to any disclaimer, the term of this patent is extended or adjusted under 35 U.S.C. 154(b) by 415 days.

(21) Appl. No.: 13/285,109

(22) Filed: Oct. 31, 2011

(65) Prior Publication Data

US 2012/0103628 A1 May 3, 2012

Related U.S. Application Data

(60) Provisional application No. 61/408,780, filed on Nov. 1, 2010.

(51) Int. Cl.
*E21B 34/10* (2006.01)
*E21B 43/26* (2006.01)

(52) U.S. Cl.
CPC ..... *E21B 34/108* (2013.01); *E21B 43/26* (2013.01); *E21B 34/10* (2013.01)
USPC ..... 166/319; 166/250.01; 166/308.1; 166/373; 251/47

(58) Field of Classification Search
USPC ..... 166/373, 308.1, 66.6, 66.7, 64, 177.5, 166/332.1, 319, 386, 320, 317; 251/47, 28, 251/50; 137/68.13, 624.11
See application file for complete search history.

(56) References Cited

U.S. PATENT DOCUMENTS

| | | | | |
|---|---|---|---|---|
| 3,233,674 | A * | 2/1966 | Leutwyler | 166/63 |
| 4,858,690 | A * | 8/1989 | Rebardi et al. | 166/278 |
| 4,896,722 | A * | 1/1990 | Upchurch | 166/250.15 |
| 5,103,906 | A * | 4/1992 | Schultz et al. | 166/264 |
| 5,343,963 | A * | 9/1994 | Bouldin et al. | 175/27 |
| 6,817,410 | B2 | 11/2004 | Wetzel et al. | |
| 7,377,321 | B2 * | 5/2008 | Rytlewski | 166/313 |
| 7,543,634 | B2 | 6/2009 | Fehr et al. | |
| 2003/0176221 | A1 * | 9/2003 | Chung | 463/42 |
| 2009/0272527 | A1 * | 11/2009 | Cuthill | 166/250.01 |
| 2011/0253383 | A1 * | 10/2011 | Porter et al. | 166/373 |

* cited by examiner

*Primary Examiner* — Jennifer H Gay
*Assistant Examiner* — Steven MacDonald
(74) *Attorney, Agent, or Firm* — John J. Love; Cooke Law Firm

(57) ABSTRACT

A single trip multizone time progressive well treating method and apparatus that provides a means to progressively stimulate individual zones through a cased or open hole well bore. This system allows the operator to use pre-set timing devices to progressively treat each zone up the hole. At each zone the system automatically opens a sliding sleeve and closes a frangible flapper, at a pre-selected point in time. An adjustable preset timing device is installed in each zone to allow preplanned continual frac operations for all zones. The apparatus is present as a "Frac Module" that can consist of three major components, a packer, a timing pressure device, and a sliding sleeve/isolation device. A hydraulic packer may be removed or replaced with a swellable type packer.

13 Claims, 5 Drawing Sheets

APPARATUS FOR SINGLE-TRIP TIME PROGRESSIVE WELLBORE TREATMENT

This application claims priority to U.S. provisional application Ser. No. 61/408,780 filed on Nov. 1, 2010.

BACKGROUND OF INVENTION

1. Field of the Invention

The present invention relates to apparatus and methods for oil and gas wells to enhance the production of subterranean wells, either open hole, cased hole, or cemented in place and more particularly to improved multizone stimulation systems.

2. Description of Related Art

Wells are drilled to a depth in order to intersect a series of formations or zones in order to produce hydrocarbons from beneath the earth. Some wells are drilled horizontally through a formation and it is desired to section the wellbore in order to achieve a better stimulation along the length of the horizontal wellbore. The drilled wells are cased and cemented to a planned depth or a portion of the well is left open hole.

Producing formations intersect with the well bore in order to create a flow path to the surface. Stimulation processes, such as fracing or acidizing are used to increase the flow of hydrocarbons through the formations. The formations may have reduced permeability due to mud and drilling damage or other formation characteristics. In order to increase the flow of hydrocarbons through the formations, it is desirable to treat the formations to increase flow area and permeability. This is done most effectively by setting either open-hole packers or cased-hole packers at intervals along the length of the wellbore. These packers isolate sections of the formations so that each section can be better treated for productivity. Between the packers is a frac port and in some cases a sliding sleeve or a casing that communicates with the formation or sometimes open hole. In order to direct a treatment fluid through a frac port and into the formation, a seat or valve may be placed above a sliding sleeve or below a frac port. A ball or plug may be dropped to land on the seat in order to direct fluid through the frac port and into the formation.

One method, furnished by PackersPlus, places a series of ball seats below the frac ports with each seat size accepting a different ball size. Smaller diameter seats are at the bottom of the completion and the seat size increases for each zone as you go up the well. For each seat size there is a ball size so the smallest ball is dropped first to clear all the larger seats until it reaches the appropriate seat. In cases where many zones are being treated, maybe as many as 20 zones, the seat diameters have to be very close. The balls that are dropped have less surface area to land on as the number of zones increase. With less seat surface to land on, the amount of pressure you can put on the ball, especially at elevated temperature, becomes less and less. This means you can't get adequate pressure to frac the zone because the ball is so weak, so the ball blows through the seat. Furthermore, the small ball seats reduce the I.D. of the production flow path which creates other problems. The small I.D. prevents re-entry of other downhole devices, i.e., plugs, running and pulling tools, shifting tools for sliding sleeves, perforating gun size (smaller guns, less penetration), and of course production rates. In order to remove the seats, a milling run is needed to mill out all the seats and any balls that remain in the well.

The size of the ball seats and related balls limits the number of zones that can be treated in a single trip. Furthermore, the balls have to be dropped from the surface for each zone and gravitated or pumped to the seats.

Another method, used by PackersPlus, U.S. Pat. No. 7,543,634 B2, places sleeves in the I.D. of the tubing string. These sleeves cover the frac ports and packers are placed above and below the frac ports. Varying sizes of balls or plugs are dropped on top of the sleeves and when pressuring down the tubing, the pressure acts on the ball and the ball forces the sleeve downward. Once again you have the restriction of the ball seats and theoretically, and most likely in practice, when the ball shifts the sleeve downward, the frac port opens and allows the force due to pressure diminish off before the sleeve is fully opened. If the ball and sleeve remain in the flow path, the flow path is restricted for the frac operation.

It would be advantageous to have a system that had no ball seats that restrict the I.D. of the tubing and to eliminate the need to spend the time and expense of milling out the ball seats, not to mention the debris created by the milling operation. Also, it would be beneficial to have a system that automatically fully opens each sliding sleeve and isolates the zone below, progressively up the well bore, before each zone is stimulated. Such a system allows stimulation of one zone at a time to achieve the maximum frac efficiency for each zone. In addition, it would be advantageous to be able to, in the future, isolate any zones by closing a sliding sleeve. For example, a single zone could be shut off if it began producing water or became a theft zone.

Furthermore, it would be greatly advantageous to eliminate the time and logistics required for dropping numerous balls into the well, one at a time, for each zone in the well to be treated. It would also be advantageous to have a multizone frac system that functioned automatically while all zones were being stimulated in order to minimize the time surface pumping equipment is setting idol between pumping zones.

Many wells are being stimulated at multiple zones through the well bore by use of composite plugs such as the "Halliburton Obsidian Frac Plug" or the "Owen Type 'A' Frac Plug". A composite plug is set near, or below, a zone and then the zone is treated. Another composite plug is set in the next upper zone and that zone is treated, and so on up the well bore until multiple plugs remain in the well. The composite plugs are then drilled out which can be time consuming and expensive. The shavings from the mill operation leave trash in the well and can also plug off flow chokes at the surface. It would be advantageous to have a system that eliminated the use and drilling out of composite or millable plugs. Of course, this approach would apply to new well completions where equipment, of the present invention, could be placed into the well prior to treating.

Other well completions, such as intelligent wells, are designed to operate downhole devices by use of control lines running from the surface to various downhole devices such as packers, sleeves, valves, etc. An example of this type of system can be found in Schlumberger U.S. Pat. No. 6,817,410 B2. This patent describes use of control lines and the various devices they operate. It is obvious the use of control lines can make the completion very complicated and expensive. The present invention allows operation of some types of downhole devices possible without the use of control lines. For example, the present invention describes a timer/pressure device that could be placed both above and below a sliding sleeve, and days, months, or even years later, a sliding sleeve, or series of sliding sleeves, could be programmed to open or close.

There are other wells that sometimes require well intervention. A product called a Well Tractor, supplied by Welltec, is used to aid in shifting sliding sleeves opened or closed in long horizontal wells or highly deviated wells, sometimes in conjunction with wireline or coiled tubing operations. The present invention offers an alternate and more economical solution to functioning downhole devices in wells without well intervention.

BRIEF SUMMARY OF THE INVENTION

This invention provides an improved multizone stimulation system to improve the conductivity of the well formations with reduced rig time, no milling, and no control lines from the surface and, for some other applications, reduce well intervention. The equipment for all zones can be conveyed in single work string trip and frac units can stay on location one time to treat all zones.

This invention relates to an automatic progressive stimulation system where no control line or ball drop apparatus are needed. This system can also eliminate the need to set and mill out composite plugs in newly planned well completions. When single zone or multiple zone wells are to be completed with plans of stimulation and then producing, the equipment in the present invention can be utilized. This invention is comprised of three major components; a packer, a timer/pressure device, and a sliding sleeve/valve assembly. Although, in some cases, a packer may not be needed. The combination of these three components has been given the name "Frac Module".

I. The packer can be several types, such as those that set hydraulically by applying tubing pressure, those that are Swellable, or those that are Inflatable, to mention a few.

II. The timer/pressure device is a device that can be actuated by application of well pressure such as tubing pressure or annulus pressure. This pressure can act on a pressure sensitive device, which in turn triggers a timing device where the timing device can be set to any desired time, before it triggers a pressure generating device which is turn applies pressure to a downhole tool in order to activate the tool.

III. The sliding sleeve is a typical type sleeve that can open or close a port, or series of ports, that allow fluids or slurries to travel down the well conduit, through the ports, and communicate with the formation. For the present invention, the sliding sleeve would be of the piston type where pressure acts on a piston and in turn shifts the sleeve. A frangible flapper valve, or other type of valve, is positioned above the sliding sleeve and closes when the sliding sleeve shifts downward. The valve directs flow through the ports in the sliding sleeve and isolates the zone below.

A series of frac modules placed in the well act in unison, where all packers are set at once and all timers/pressure devices are triggered at once, with a single application of tubing pressure. Each timer in each zone can be set to a desired time so that, for example, the lowermost timer actuates a pressure generating device after one hour from the time when tubing pressure was initially applied. The pressure generating device creates pressure that communicates with a piston on the sliding sleeve to open the sliding sleeve and close the flapper valve. This first zone is treated through the sliding sleeve ports before the next upper sliding sleeve opens.

The next upper Frac Module timer is set for 2 hours, for example, from the time when initial tubing pressure was applied. At the end of the two hour time period, the timer actuates a pressure generating device to open its sliding sleeve so the zone can be treated. Timers in each zone can be set to the desired time to allow stimulating as many zones as required.

The timing devices can be set so that all zones can be nearly continuously treated in order to optimize the use of surface stimulation equipment. The timers are versatile enough where all the timers can be triggered at once. A portion of timers can be triggered at one selected pressure while others are triggered at different selected pressures, or sequences of applied pressures.

To those familiar with the art of well completions, it is obvious that the scope of this invention is not limited to just timer/pressure generating devices shifting sliding sleeves open or closed but can also be used to actuate any type or combination of a downhole tool device, or devices, in any timing sequence, such as perforating guns, valves, packers, etc. More than one timing/pressure device can be used to function a single type multiple times by setting the timers at different time spans.

BRIEF DESCRIPTION OF THE SEVERAL VIEWS OF THE DRAWING(S)

FIGS. 1, 2, and 3 placed end-to-end make up a schematic view of an embodiment of the present invention.

DETAILED DESCRIPTION OF THE PREFERRED EMBODIMENTS

Figure 1:
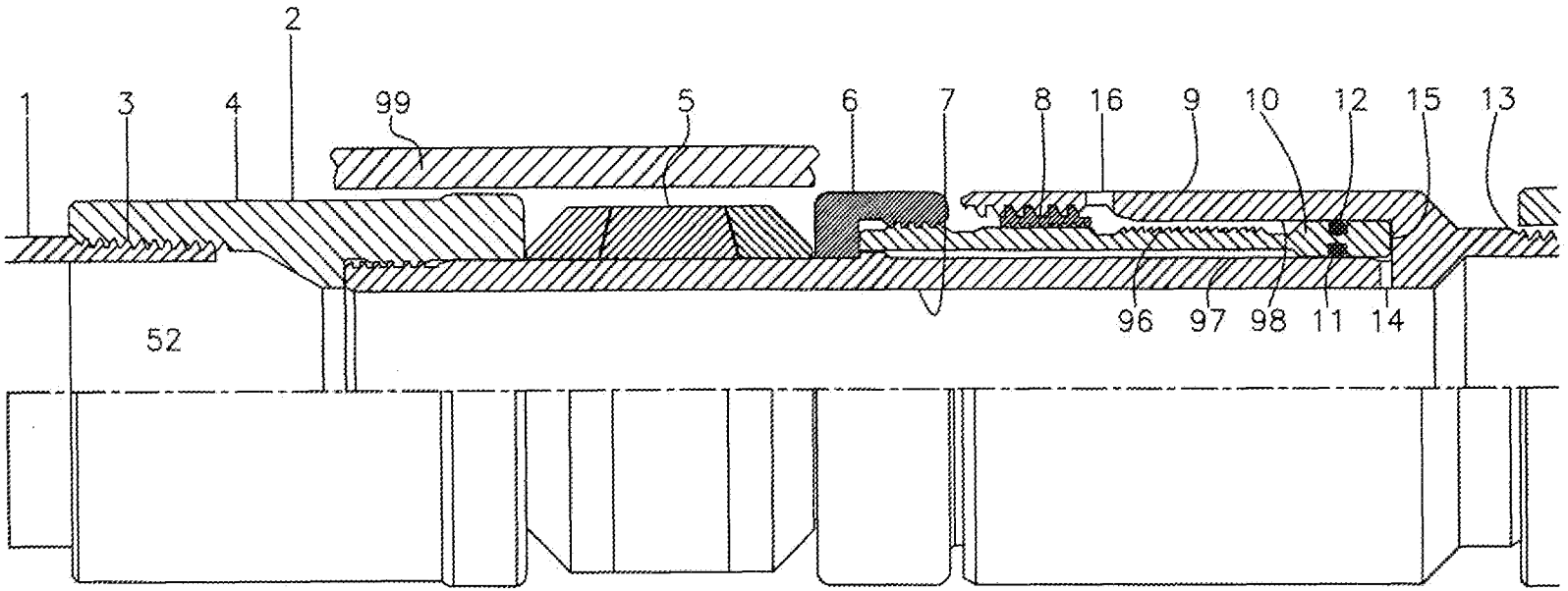

With reference to FIG. 1, a schematic of an embodiment of the present invention shows a 90 degree lengthwise cross-section of the apparatus. This portion of the apparatus is a simplified view of a tubing pressure hydraulically set packer 2, although packers such as swell and inflatable packers may be used. A packer maybe used that has a slip system added and a packer may be used that has a release device added.

Tubing string 1 has a connecting thread 3 that connects to top sub 4. Top sub 4 threadably connects to packer mandrel 7. Packing element 5 and gage ring 6 are positioned over Mandrel 7. Ratchet ring 8 is located and threadably locked inside housing 9. Piston 10 is threadably connected to gage ring 6 and ratchet ring 8 engages piston thread 96 as piston 10 strokes upward (left end of drawing). Seals 11 and 12 form a seal in bores 97 and 98 and between piston 10. Tubing pressure 52 enters port 14 and acts across seals 11 and 12 to move piston 10 upward compressing packing element 5. Fluid is displaced through port 16. Ratchet ring 8 locks piston 10 so the packing element 5 stays compressed and sealed inside outer casing 99. Housing 9 has pin thread 13 facing downward.

Figure 2:
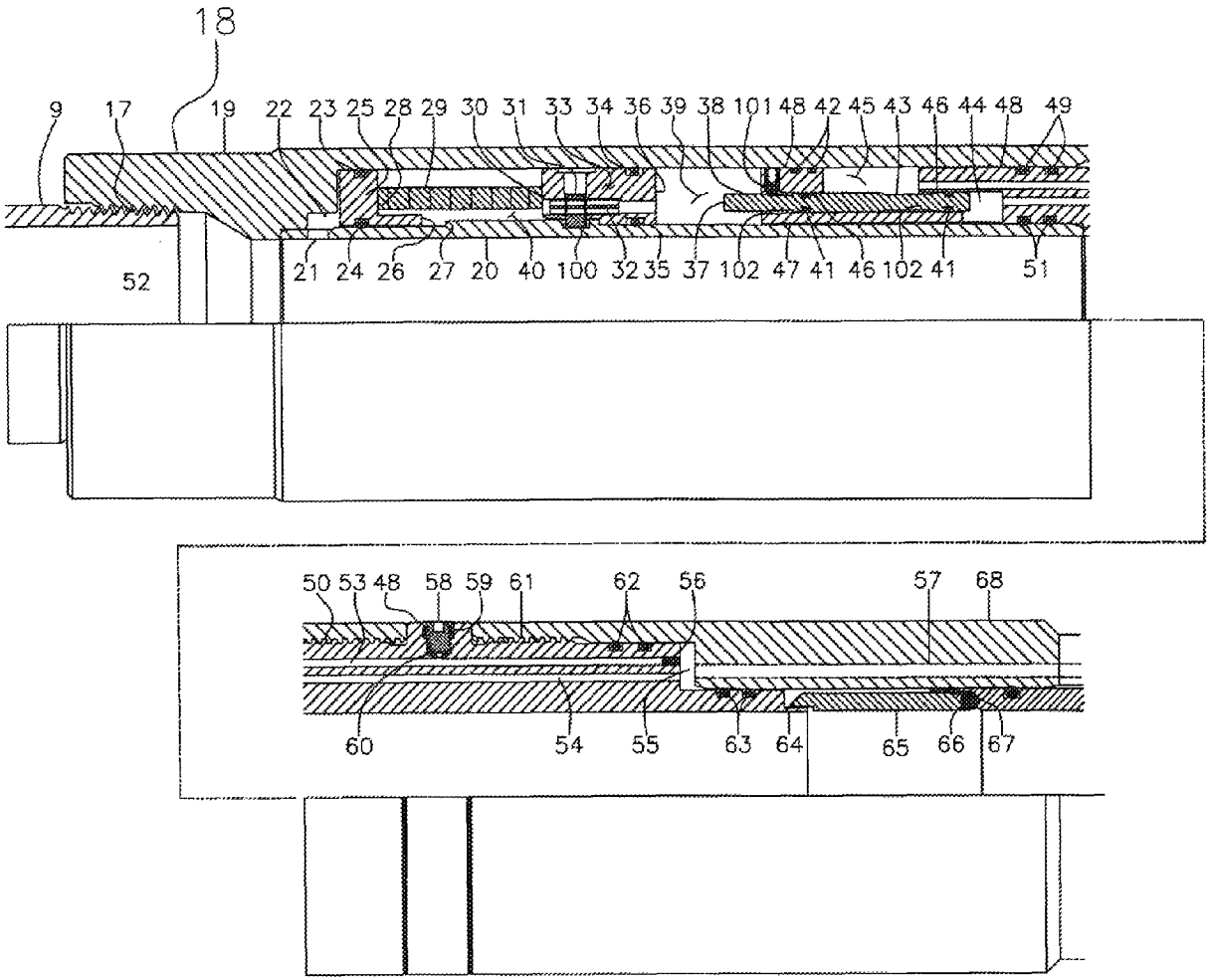
Figure 5:
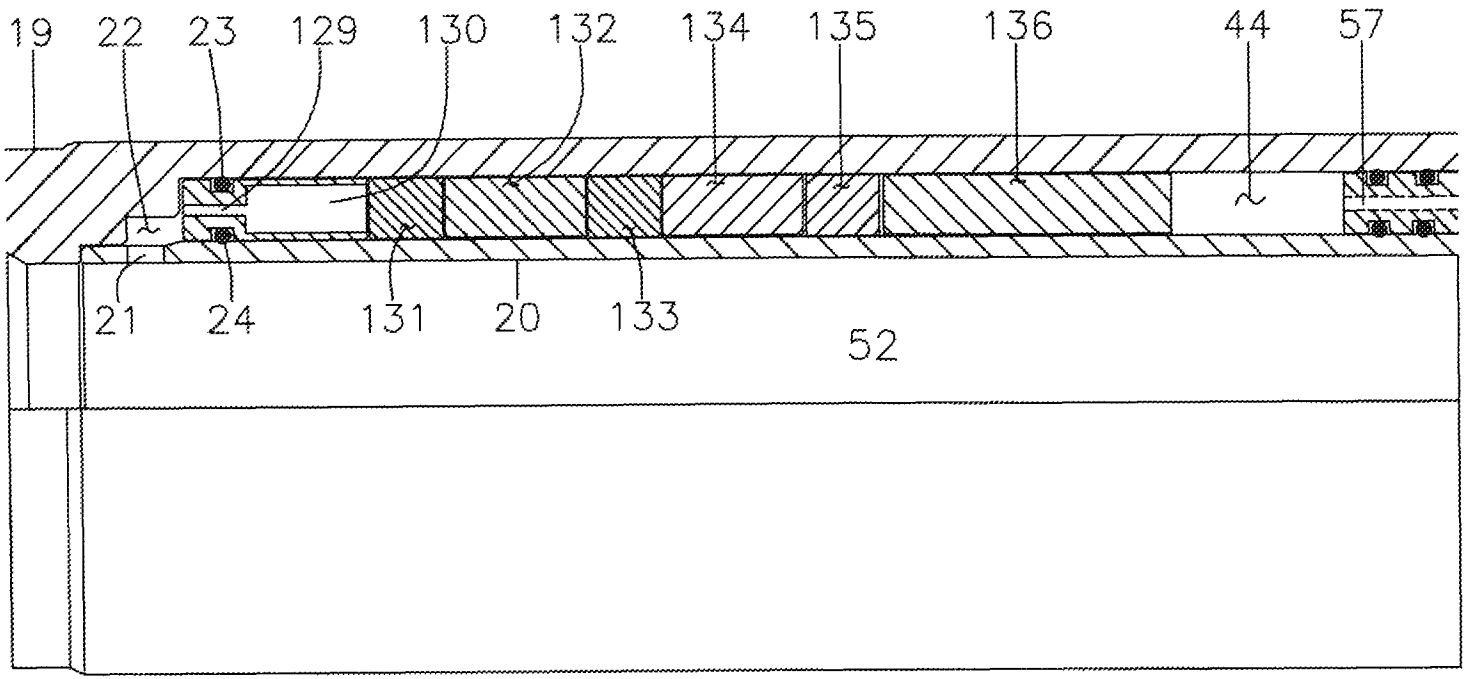
FIG. 5 is a schematic showing a second embodiment of a timer/pressure device that can be used in the Frac Module.

Referring to FIG. 2, the timer/pressure assembly 18 is shown in a schematic. This schematic illustrates a totally mechanical timing/pressure device although other types of devices can be substituted such as a pressure sensitive pressure transducer interconnected to an electronic timer that initiates a pyrotechnics gas pressure generating device, for example. Such a device is shown in FIG. 5.

Referring to the schematic, thread 17 of pin 13 connects to outer chamber 19. Inner chamber 20 is trapped inside outer chamber 19 to form an annular space between the two chambers. Piston 25 has seals 23 and 24 that seal inside of inner and outer chambers 19 and 20. Tubing pressure 52 enters port 21 and chamber 22 to act on piston 25. The top end of compression spring 29 is shown in a near solid height condition where spring 29 makes solid contact with piston 25 at location 28.

The bottom end of compression spring 29 makes solid contact with Orifice piston 33 at location 30. Shear screws 31 shearably connect orifice piston 33 to inner chamber groove 100. Piston 25 is allowed to stroke downward until face 26 contacts shoulder 27.

A flow control device, such as a LEE Visco Jet 32 is located inside of orifice piston 33 so that fluid, such as silicone oil, located in chamber 39 can only pass thru Visco Jet 32 and into chamber 40. Seals 34 and 35 seal orifice piston 33 on the inside walls of chamber 39. Orifice piston 33 has face 36 that travels through chamber 39 to make contact with face 37 of pressure release rod 38. Pressure chamber 48 is threadably connected to outer chamber 19 at thread 50. Seals 42 and 49 isolate chamber 45 where chamber 45 is charged with a pressurized gas, such as nitrogen. Seals 41 on both ends of pressure release rod 38 also isolate chamber 45 to hold pressurized gas within the chamber. Chamber 39 communicates with chamber 44 through gap 47.

Bores 46 inside of pressure chamber 48 are of near equal, or equal, diameter and seals 41 are of near, or equal, diameter so that pressure release rod 38 is in the pressure balanced condition when exposed to pressure from either chambers 39 or 45. Pressure release rod 38 is held relative to chamber 48 by a low force spring loaded detent ball 101 to prevent pressure release rod 38 from moving until contacted by orifice piston face 36.

Chamber 45 is charged with high pressure nitrogen gas through nitrogen charge valve 58 and longitudinal hole 53. Hole 53 is sealed off at one end with plug 56 but is open to chamber 45 at the opposing end. Seals 59 and 60 seal the nitrogen charge valve 58 in order to prevent passage of gas out of chamber 45 and past the valve 58.

A doughnut sleeve with internal o-rings and a sealed allen wrench, not shown, slides over nitrogen charge valve 58 to allow unscrewing Valve 58 to allow passage of gas through the doughnut and into chamber 45. Once chamber 45 is at the desired pressure, the valve 58 is closed with the allen wrench to seal the chamber 45.

Upper sleeve housing 68 is threadably attached to chamber 48 with thread 61 and sealed with seals 62. Longitudinal hole 54 communicates with chamber 44, not exposed to charged gas pressure at this time, and chamber 55 and hole 57. Seals 63 isolate chamber 55 from pressure 52. Seals 51 isolate pressure 52 from chambers 39 and 44.

Pressure release rod 38 has recesses 43 and 102 so when shifted downward by spring force in spring 29 and face 36, seal 41 leave seal bore 46 and pressurized gas can move from inside chamber 45 to chamber 55 and into hole 57.

Frangible flapper valve 65 is mounted by axle 66 and is spring biased with spring 67 to rotate from the open position, shown, to the dosed position. Finger 64 temporarily holds the Flapper 65 in the open position. Axle 66 is positioned on the upstream portion of sleeve 71 and is carried by it.

Figure 3:
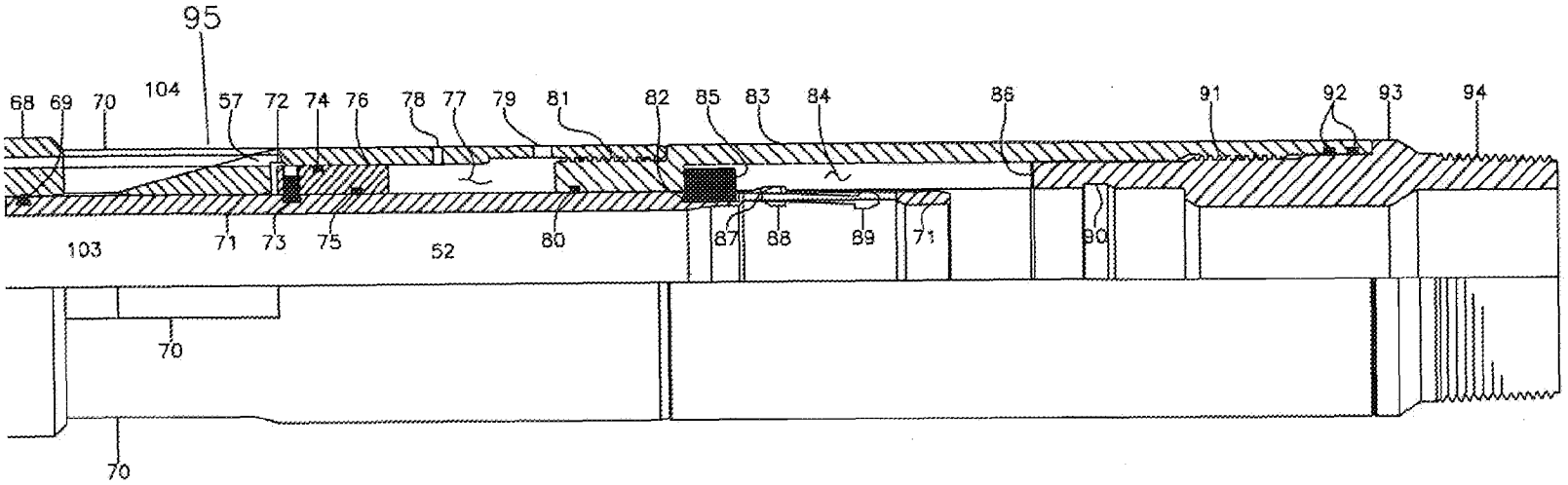

Referring to FIG. 3, this schematic shows ported sliding sleeve 95. Upper sleeve housing 68 shows the continuation of hole 57 that communicates with chamber 72. Sleeve piston 76 has seal 74 and 75 that isolate chambers 72 from 77. Screw 73 connects piston 76 to sleeve 71. Seal 69 isolates chamber 72 from pressure 52 and seal 80 isolates chamber 77 from pressure 52. Seals 69 and 80 are of the same diameter so that sleeve 71 is pressure balanced, or near pressure balanced from pressure 52 so pressure 52 does tend to move sliding sleeve 71 up or down. Gas pressure in chamber 72 acts on piston 76 to move sliding sleeve 71 downward or to the open position.

Single or multiple ports 70 go through the wall of upper sleeve housing 68 and sleeve 71 and seals 69 and 80 prevent pressure or fluid from traveling from location 103, through ports 70 and to location 104, or vice versa. If pressure in chamber 72 is greater than pressure in chamber 77 and pressure acts on piston 76, the piston 76 and sliding sleeve 71 will move downward toward chamber 77. During this movement, fluid exits ports 78 and 79 to area 104. When seal 74 passes port 78, gas pressure above piston 76 and in chamber 72 passes through port 78 allowing the gas pressure to equalize.

Downward movement of sleeve 71 allows seal 69 to move past port 70 so that flow passage can occur from area 103 to area 104. Also, when the sliding sleeve 71 moves downward, flapper 65 moves away from finger 64 and rotates around axle 66 allowing spring 67 to rotate flapper 65 to the closed position.

Collets 88 and 89 are common to sliding sleeves and come in different geometries. The collets lock the sliding sleeve 71 either in the up or down position in recesses 87 and 90. Shifting tool profiles are added to the inside of the sliding sleeve 71 to use mechanical shifting tools run on wireline or tubing, to shift the sliding sleeve 71 closed or back open at some future time.

Sleeve housing 83 is threadably connected to upper sleeve housing 68 with thread 81. A stop key 85 may be employed to engage shoulder 86 to stop the downward movement of sliding sleeve 72 as to not load collets 88 and 89 in compression. Stop key 85 sets in pocket 82 and can move downward in slot 84.

Bottom sub 93 is threadably attached to sleeve housing 83 with thread 91 and is sealed with seals 92. Pin thread 94 connects to a tubing spacer which in turn connects to another Frac Module or possibly a bottom locator seal assembly that stings into a sump packer.

Figure 4:
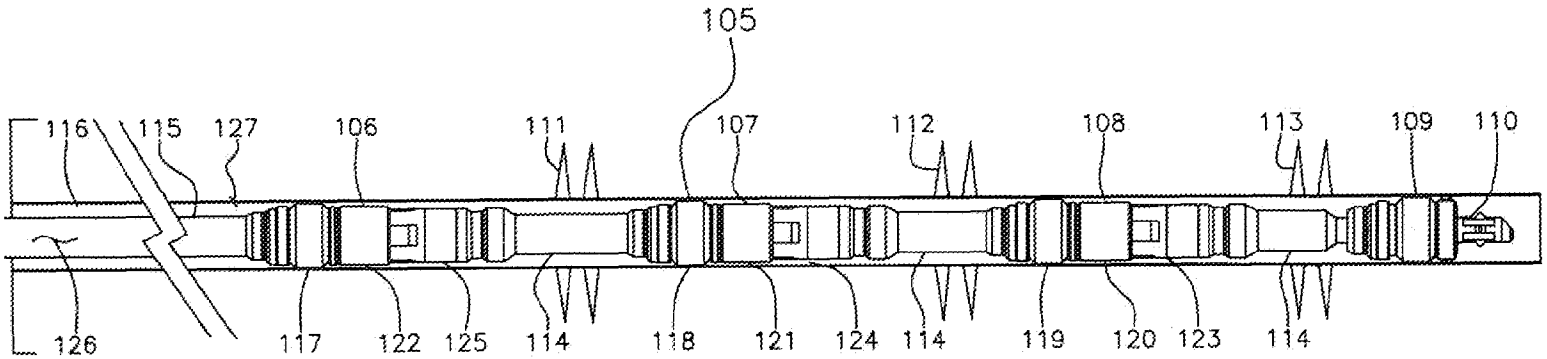
FIG. 4 is a schematic view of three Frac Modules assembled in tandem in a well completion.

Referencing FIG. 4, this schematic shows a possible completion hookup 105 using three Frac Modules 106, 107, and 108 although many Frac Modules may be used. The well has casing 116 and below location 127 the well casing 116 can continue or the well can be open hole passing through zones 111, 112, and 113. Packers 117, 118, and 119 can be tubing pressure hydraulic set packers for cased hole or swellable or tubing pressure set inflatable packers for either cased hole or open hole. Each zone can have a timer/pressure device 122, 121, and 120 and a ported sliding sleeve valve assembly 125, 124, and 123. Each zone can be separated by tubing spacers 114 and tubing 115 runs to the surface or a hydraulic set production packer (not shown). A sump packer 109 can be set prior to running the completion string of frac modules. The bottom of the completion string can have a typical locator seal assembly 110 that stings into sump packer 109. If it is desired not to run a sump packer 109, the sump packer can be replaced with an additional tubing pressure set hydraulic packer that is set by dropping a ball on a seat below the packer. In either case, all tubing pressure set packers will set at the same time, if desired. Each zone is isolated with packers set above and below each zone and the sliding sleeves in the closed position.

Referring to FIG. 5, this is a schematic of an embodiment of the present invention showing a second method of producing pressure to shift a sliding sleeve or other downhole device. Referencing FIG. 2, this device can be put in the place of the device described in FIG. 2.

Once again, there is an outer chamber 19, an Inner chamber 20, a port 21, a chamber 22, seals 23 and 24, a chamber 44, and a hole 57. Pressure from area 52 enters port 21 into chamber 22 and into hole 129. Pressure in hole 129 acts on a pressure sensitive device, such as a pressure transducer 130. The pressure transducer triggers a switch 131 that starts an adjustable timer 132 that is set for a time frame, say 4 hours. The timer can be pre-set at the surface prior to running the tools into the well. The timer can be set for any time increment desired, for example from 1 minute to 100 hours, or longer. At the end of 4 hours it triggers a switch 133 to supply battery power 134 to an Igniter 135, or initiator. The battery power can also run the timer or the timer can be purely mechanical. Power supplied to the igniter 135 triggers the igniter 135, or initiator, to cause the material in the gas generator 136 to burn, react, or mix, and produce high pressure gas. The high pressure gas pressure increases in chamber 44, travels through hole 57 to act on the piston 76, shown in FIG. 3. Pressure on the piston 76, shifts the sliding sleeve 71 to the open, or down, position. Components 130, 131, 132, 133, 134, 135, and 136 can be moved, or substituted with other mechanisms, to different relative positions to achieve the same goal of producing gas pressure. These components can be in a single cartridge modular form, say one assembly, and can be miniaturized or improved by use of microelectronics. Also, more than one timer/pressure device can be used for redundancy and reliability purposes.

The device in FIG. 5, and the device in FIG. 2, illustrate that more than one technique can be used to create a timer/pressure device, and the present invention is not limited to one technique.

Furthermore, it is important to recognize that the timer/pressure device described in FIGS. 2 and 5 can be positioned relative to the sliding sleeve, FIG. 3, either above or below the sliding sleeve, although if the timer/pressure device were positioned below the sliding sleeve, the hole 57 arrangement would be slightly more complicated when shifting the sleeve upward. A first timer/pressure device can be used to open the sleeve and a second timer/pressure device can be positioned below the sliding sleeve to close the sliding sleeve at a specified time in the future.

Description of Operation

With reference to the example in FIG. 4, a typical completion is shown but many variations of this occur as known by those who are familiar with the variations that occur in configuring well completions.

A well has been drilled, cased, cemented, and perforated, although this system may be used in open hole completions with selection of the appropriate packers. Casing 116 is shown in this example with zones and perforations 111, 112, and 113 in the casing. The objective is to stimulate all of the zones 111, 112, and 113 in a single trip without well intervention. A sump packer 109 is properly located and set below the lowermost zone 113 although this packer may be substituted with a packer similar to packer 119 by landing a ball against a seat below where packer 109 is shown.

A "completion string" is run into the well consisting of a locator snap latch seal assembly 110, tubing spacer 114, frac module 108, tubing spacer 114, frac module 107, tubing spacer 114, frac module 106, tubing spacer 114, a service/production packer (not shown), and work string or production 115. The length of tubing spacers 114 are made to position the frac modules 106, 107, and 108 between the producing zones 111, 112, and 113.

The single trip completion string is landed in sump packer 109. The location of sump Packer 109 is based on logs of the zones so that all equipment could be spaced out properly. Therefore, by locating the completion assembly on the sump packer 109, all Frac Modules 106, 107 and 108 will be properly positioned in the well. Snap latch seal assembly 110 can be used to verify position of the system before setting any of the packers 117, 118, and 119. The locator snap latch seal assembly 110 seals in the sump packer 109 and will locate on the sump packer. The locator snap latch seal assembly 110 is designed to allow pulling of the work string 115 to get a load indication on the sump packer 109 and then snap back in and put set-down weight on the sump packer 109. The above steps are common in the art of completing wells.

At this point in time the completion hardware, shown in FIG. 4, is properly positioned around all the zones to be stimulated. All stimulation equipment has been positioned around the well at the surface and all frac lines have been assembled and pressure tested. A pumping company has done stimulation pre-planning for each zone and has all the necessary materials ready to pump, along with backup surface units. The Frac Module Timers were all set prior to running the system into the well but at this point in time, none of the timers have been actuated. The pumping company knows how long it will take to pump each zone and the timers were pre-set based on how long it will take to frac each zone. The timers were pre-set to allow extra time for any required surface operations during the overall process.

Now that the completion system is in the proper position in the well and all surface equipment has been nippled-up, the zones are ready to stimulate.

At this point all the sliding sleeves in each Frac Module are in the closed position. The operator may decide to do a low pressure system pressure test at this time before actuating any downhole devices. The entire system is pressured up, for example, to 500 psi and held for a period of time until there is proof of no leaks in the system.

At this point all surface equipment is running and the well is ready to stimulate. The first step is to set all of the packers, assuming that they are hydraulic tubing pressure set packers. If they are swellable packers, the operator will wait to begin operations until all of the Swellable packers have had time to swell.

Continuing and assuming the packers are tubing pressure set, the surface pump units begin applying tubing pressure 126 inside of work string 115 to packer setting ports 14. All of the packers may be designed to begin setting at 1,500 psi and may not fully set until the tubing pressure reaches 3,500 psi, for example. This pressuring operation will take several minutes.

The same pressure 52 used to set the packers 117, 118, and 119, also reaches the Frac Module timer pressure devices 122, 121, and 120. In this case, all of the timers have been set to actuate close to the exact same time so when the tubing pressure reaches 1,500 psi, for example, all the devices 122, 121, and 120 start counting time. If the lowermost zone 113 is to be stimulated first, the timer in device 120 may have been set at 30 minutes, i.e., the amount of time before the first sliding sleeve 123 is opened and the flapper in the closed position. The timer is zone 112 may be been set for 2 hours and the timer in zone 111, may have been set for 3 hours.

At this point in time, possibly 15 minutes after initial setting pressure was applied, all of the packers are set and all of the timers are running. It is now critical to begin pumping the job since the timer clocks are ticking. The first zone 113 will need to be fraced but the sliding sleeve 123 in Frac Module 108 must first open. The following paragraphs will explain how the Sliding sleeve 123 opens.

Referring to FIGS. 2 and 3, pressure in area 52 enters port 21 and chamber 22 and acts on Piston 25. Piston 25 and solid height compressed spring 29 pushes on orifice piston 33. As piston 25 face 26 moves to shoulder 27, shear screws 31 shear against groove 100. The shear screws 31 may be set to shear at 1,500 psi applied to piston 25. The force in spring 29 has sufficient force to move orifice piston 33 downward against the fluid in chamber 39. The fluid in chamber 39 must be forced through Lee Visco Jet 32. The Visco Jet has a Lohm rating that allows fluid to travel through the jet at a specified rate with a specified fluid, such as silicone oil, 200 cs. The specified flow rate of the fluid, the load of spring 29, and the total volume of fluid in chamber 39, controls the velocity and time in which the orifice piston moves toward rod 38. The variables of spring load, Jet Lohm rating, fluid type, and total fluid volume can be adjusted ahead of time to achieve a 30 minute time dwell until face 36, of orifice piston 33 contacts face 37 of the rod 38.

The spring 29 has sufficient load and stroke to move rod 38 downward through charged nitrogen chamber 45. When the rod undercuts 102 of rod 38 move downward and seals 41 move out of seal bores 46, nitrogen gas is allowed to exit chamber 45 and enter chamber 44, hole 54, and hole 57. The gas pressure is of sufficient magnitude so when it acts on sliding sleeve piston 76, the sliding sleeve 71 is shifted downward to open up frac port 70. Frac port 70 then allows fluid communication form area 103 to area 104.

Simultaneously, flapper 65 is pulled downward away from finger 64, and flapper 65 rotates around axle 66, and is biased to the closed position by spring 67 to form a seal on top of sliding sleeve 71. Once the sliding sleeve 71 is fully shifted downward, excess nitrogen gas is allowed to escape through port 78 in order to equalize pressure around the sliding sleeve 71. This is important in case the sliding sleeve 71 needs to be shifted closed by mechanical shifting tools, at a later point in time after the well has been treated. The seals 23 and 24 on piston 25 provide a seal to prevent communication of fluid backward from port 78 to port 21 or vice versa. In this case, once the sliding sleeve 71 is fully shifted down, the collets 89 lock in groove 90 to hold the sliding sleeve in the open position. Likewise, when the sliding sleeve 71 is closed, collets 88 lock in groove 87 to hold the sliding sleeve 71 in the closed position.

At this point in time, the sliding sleeve 123 is shifted open and the flapper 65 is sealing the top of the sliding sleeve 71 so when pumping fluid from the surface of the well, fluid will not pass through the inside of sliding sleeve 71, but will be blocked by the flapper 65 and directed through frac Port 70 and into formation 113.

Formation 113 is treated by pumping fluid, or slurry, down work string 115, through the upper Frac Modules 106 and 107 and out of ports 70 located in Frac Module 108, and thru perforations 113 and into formation 113. This operation has been planned by the pumping company to be complete before the 2 hour time period programmed in Frac Module 107. Of course the 2 hour time period could have been reduced to minimize the time between treating zones.

After 2 hours from the original initiation point of setting the packers and starting the timers, the sliding sleeve 71 in Frac Module 107 opens and flapper 65 closes per the above described process, so zone 112 can now be treated.

This process continues for all zones that are in the completion and stimulation program for the well. As each zone is treated up the well, each Frac Module operates independently from the others, so failure of one to operate does not affect the operation of the others.

Once all zones are treated, the surface stimulation equipment can move off location. Flow from the formations can be used to attempt to clean up the well. The flow will open the flappers and allow fluid to move up hole.

It is also common practice to go back in the well, wash out excess proppant, if proppant was used, break the frangible flapper disc's, and close sliding sleeve 71 for zone isolation, if desired. The Sliding sleeves have profiles machined in the inside of the sleeves so that standard type mechanical shifting tools can be used to either open or close the ports 70.

I claim:

1. A single trip well stimulation tool comprising:

a plurality of valve mechanisms;

a plurality of tubulars connected between the valve mechanisms;

a plurality of time variable valve actuators;

whereby a plurality of repeating modules of a valve mechanism, a time variable valve actuator are formed in series; and wherein the time variable valve actuators include a first piston having a surface exposed to pressure within the tubulars, an orifice piston having a flow control device therein, a chamber filled with fluid, a pressure release rod, a second chamber charged with a pressurized gas, a second piston movable within a third chamber movable by the pressurized gas in the second chamber and a sleeve connected to the second piston.

2. A tool as claimed in claim 1 where each valve mechanism comprising a first port for allowing stimulation fluid to exit the valve mechanism and a valve member to block flow through the valve mechanism when the port is in an open position.

3. The tool as claimed in claim 2 wherein each valve mechanism includes a slidable sleeve which in one position covers the port and maintains the valve member in an open position and is moveable to a second position opening the port and causing the valve member to close.

4. The tool as claimed in claim 3 wherein the slidable sleeve is moved by fluid pressure acting on a piston connected to the slidable sleeve.

5. A tool as claimed in claim 1 wherein the time variable valve actuators consist of a pressure transducer, a switch actuated by the pressure transducer, an adjustable timer activated by the switch, a second switch, a battery pack connected to the second switch, an igniter connected to the battery pack, a high pressure gas generator activated by the igniter and a piston having a surface exposed to high pressure gas when the gas generator is ignited.

6. The tool of claim 1 further including a timer actuator for each of the time variable valve actuators.

7. The tool of claim 6 wherein the timer actuator is activated by fluid pressure.

8. A tool as claimed in claim 1 further including a plurality of packers connected between the tubulars and the valve mechanisms.

9. A time variable valve actuator comprising:

a housing;

a first chamber having a fluid inlet, a first piston located in the first chamber;

a spring located in the first chamber and abutting the piston;

an orifice piston;

a shoulder in the first chamber limiting movement of the first piston;

a second chamber filed with a fluid, the orifice piston positioned between the first and second chambers;

a pressure release rod having recesses on its outer surface;

a third chamber charged with a pressurized gas; and the pressure release rod being movable within the third chamber to provide an outlet passageway from the third chamber through the recesses on the pressure release rod.

10. A time delayed actuating device for a downhole component positioned within an oil or gas well comprising:

a first tubular outer member;

a second tubular inner member positioned within the first tubular outer member and forming an annular chamber between the first tubular outer member and the second tubular inner member;

a timer assembly including a spring loaded piston, an orifice piston and a pressure release rod, located within the annular chamber;

a chamber charged with a high pressure gas; and a movable sleeve positioned within the outer housing, said movable sleeve being axially moved by fluid pressure from the chamber charged with a high pressure gas in response to axially movement of the pressure release rod.

11. A time delayed actuating device as claimed in claim 10, wherein a spring biased flapper valve is pivotably mounted on the movable sleeve at an upstream portion of the sleeve.

12. A time delayed actuating device as claimed in claim 11 further including a sleeve housing having at least one outlet port therein, said movable sleeve closing said at least one outlet port in a first position and opening said at least one outlet port in a second position.

13. A time delayed actuating device as claimed in claim 11 further including a finger engaging the flapper valve when the sleeve is in a first position, thereby preventing rotation of the spring biased flapper valve into a closed position.

* * * * *